US005921113A

United States Patent [19]

Lee et al.

[11] Patent Number: 5,921,113

[45] Date of Patent: Jul. 13, 1999

[54] CLOTHES WASHING MACHINE HAVING ELECTROLYTIC PURIFIER FOR WASTE WATER

[75] Inventors: Chang Young Lee, Kyungki-do; Hyung Kyun Kim; Jung Soo Chin, both of Suwon; Cheol Tae Lee, Seoul, all of Rep. of Korea

[73] Assignee: Samsung Electronics Co., Ltd., Suwon, Rep. of Korea

[21] Appl. No.: 08/864,349

[22] Filed: May 28, 1997

[30] Foreign Application Priority Data

Oct. 14, 1996 [KR] Rep. of Korea ..... 96-45775

[51] Int. Cl.[6] ..... D06F 39/08

[52] U.S. Cl. ..... 68/13 R; 68/208; 68/17 R; 205/742

[58] Field of Search ..... 68/208, 13 A, 68/17 R, 12.18, 12 R; 210/748; 134/1, 115 R, 186, 155; 204/157.15; 205/742

[56] References Cited

U.S. PATENT DOCUMENTS

| | | | |
|---|---|---|---|
| 3,518,174 | 6/1970 | Inoue | 113/115 R |
| 3,813,321 | 5/1974 | Bastacky | 205/742 |
| 3,846,300 | 11/1974 | Inoue | 205/742 |
| 3,926,754 | 12/1975 | Lee | 205/702 |
| 4,104,159 | 8/1978 | Kanai | 205/742 |
| 5,066,371 | 11/1991 | Devoe et al. | 205/742 |
| 5,423,962 | 6/1995 | Herbst | 205/742 |
| 5,493,745 | 2/1996 | Hauch | 68/208 |
| 5,536,389 | 7/1996 | Naour et al. | 205/742 |
| 5,611,907 | 3/1997 | Herbst et al. | 205/742 |

FOREIGN PATENT DOCUMENTS

| | | | |
|---|---|---|---|
| 23100 | 8/1987 | European Pat. Off. | 205/742 |
| 62-102891 | 5/1987 | Japan | 205/742 |
| 2 120 282 | 11/1983 | United Kingdom . | |
| WO 92/02462 | 2/1992 | WIPO | 205/742 |
| WO 94/00388 | 1/1994 | WIPO | 205/742 |

OTHER PUBLICATIONS

WPI Abstract Accession No. 88–166220(24) & J88024432B (Takeuchi Tekko KK) Jul. 14, 1983.

*Primary Examiner*—Frankie L. Stinson
*Attorney, Agent, or Firm*—Burns, Doane, Swecker & Mathis, L.L.P.

[57] ABSTRACT

A clothes washing machine has a sewage disposal apparatus using electrolysis for removing polluted matter such as surfactants, suspended solids and organic matter contained in the waste water. The electrolytic sewage disposal apparatus includes a sewage water processing tank having an inlet for receiving waste water, a processing chamber for processing the waste water, and an outlet for processed (purified) waste water. At least one pair of an anode and cathode is disposed in the processing chamber and is supplied with electric power.

8 Claims, 7 Drawing Sheets

CLOTHES WASHING MACHINE HAVING ELECTROLYTIC PURIFIER FOR WASTE WATER

BACKGROUND OF THE INVENTION

The present invention relates to a clothes washing machine having an electrolytic sewage disposal apparatus.

A conventional washing machine employs a sewage disposal apparatus having a filtration filter or an adsorption apparatus disposed at the end of a discharging tube as at sewage disposal apparatus. However, in the conventional washing machine, the filtration filter or the adsorption apparatus must be replaced periodically by new one since the efficiency thereof becomes decreased in the result of repetitive washing. Further, the filter or adsorption apparatus can remove only large-sized solid material, but it cannot remove detergent or heavy metal which is main factor for polluting water.

Generally, in a washing machine, synthetic detergents are used among the detergents. Also, an ester sulfate of a higher alcohol and a soapless soap consisting of a saturated sodium hydrogen carbonate and a benzene are also used in a washing machine.

Such synthetic detergents are excellent as washing detergents, but have several defects when compared with soaps. That is, soap molecules in sewage water which is discharged after washing are discomposed by natural bacteria during the time when the sewage water flows to a sewage disposal tank or underground. However, the molecules of the synthetic detergents are not discomposed by the bacteria. As a result, if the sewage water containing, the synthetic detergents flows into a sewage disposal tank or a river, the surface of the water is covered with the foams of the synthetic detergents, to thereby cause a severe water pollution.

The water pollution is mainly caused by living sewage water which is discharged from a home having no sufficient sewage disposal systems. The sewage water discharged after washing has the most influence on the water pollution. Thus, it is required that the living sewage water be processed by a proper sewage disposal method. Particularly, washing machines which are used in most homes need to be equipped with its own sewage disposal apparatus.

Therefore, a washing machine discharging mostly living sewage water should be equipped with a sewage disposal apparatus which can purify sewage water discharged after a washing step, using a new method other than the above two sewage disposal methods.

SUMMARY OF THE INVENTION

Therefore, to solve the above problems, it is an object of the present invention to provide a washing machine having a self-contained sewage disposal apparatus which is simple and effective, to thereby purify sewage waste water discharged after washing.

To accomplish the above object of the present invention, there is provided a washing machine having a cleaning container and an electrolytic sewage disposal apparatus, the electrolytic sewage disposal apparatus comprising: a sewage water processing tank having an inlet for receiving sewage water discharged from the cleaning container, an outlet for discharging the processed sewage water and a processing chamber for processing the sewage water; an electrode portion having at least one pair of an anode and a cathode which are spaced from each other in the sewage water processing tank and opposed to each other; and a power supply for supplying power to each of the electrodes.

Here, it is preferable that the inlet is detachably connected with a drain pipe. A filtration filter is installed upstream of the sewage water processing tank to filter-out the leftovers of textiles and solids contained in the sewage water after washing, so that a pollution of the electrodes and a lowering of the electrode reaction efficiency due to the leftovers can be prevented. Also, if the anode and cathode are each formed of a plate body, and a plurality of the electrodes forms a zigzag path for the sewage water flow, the time during which the sewage water passes through the water processing tank is extended to enable the electrodes to perform a sufficient electrolysis. Here, the electrodes can be formed of a material selected from a group consisting of an aluminum electrode, an iron electrode, and a dimensional stable anode (DSA).

DETAILED DESCRIPTION OF THE PREFERRED EMBODIMENT OF THE INVENTION

An embodiment of the present invention will be described with reference to the drawings.

Figure 1:
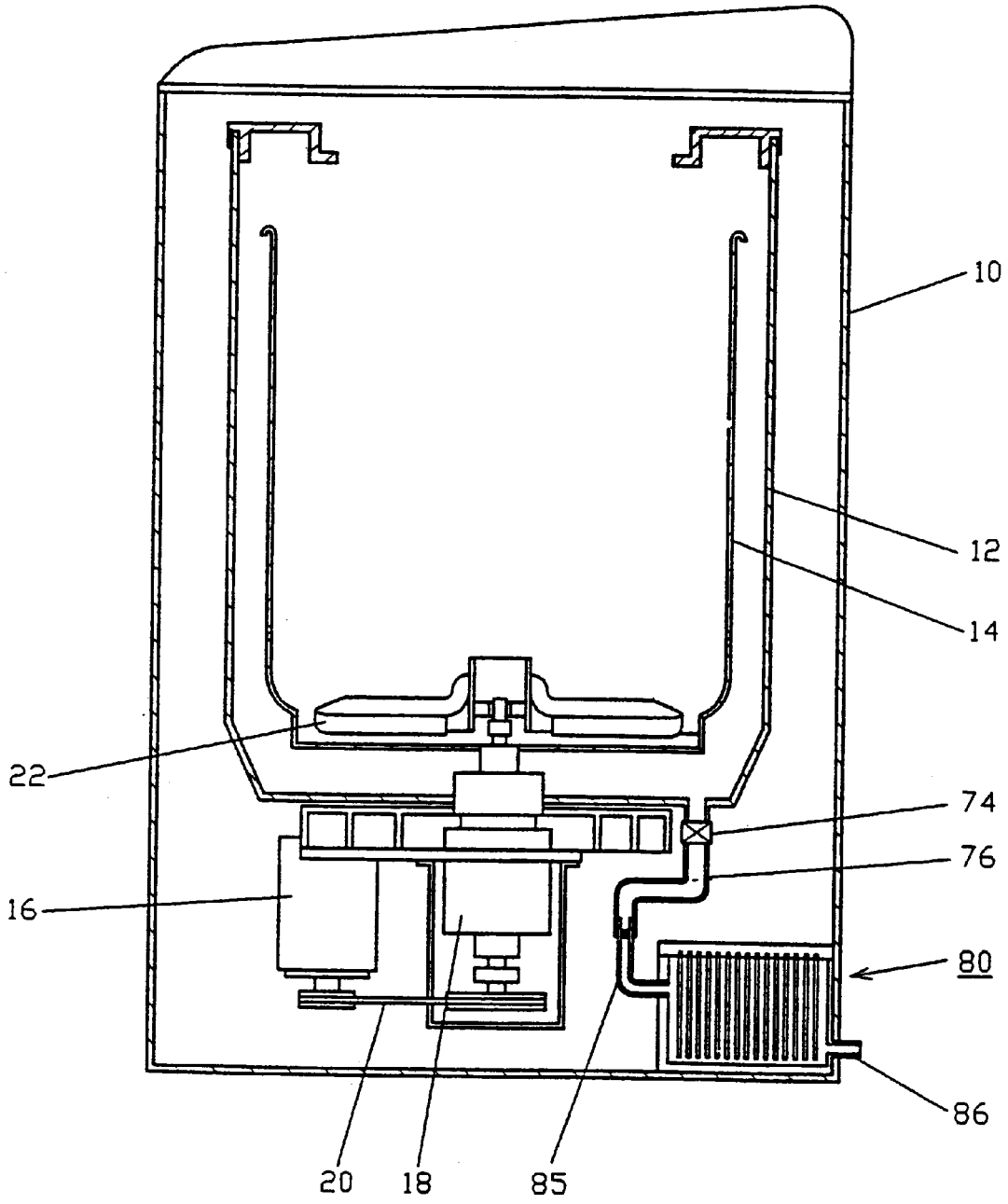
FIG. 1 is a vertical sectional view of a washing machine according to the present invention.
Figure 2:
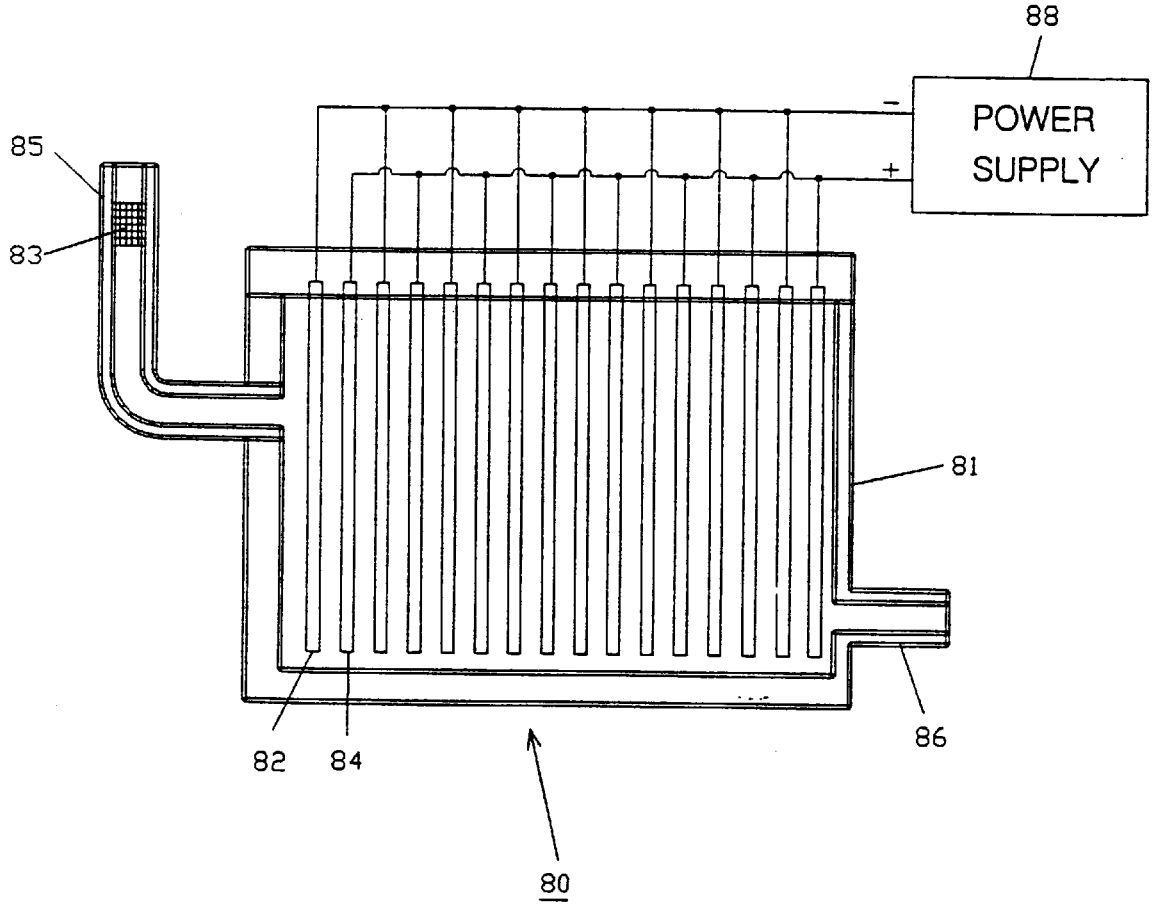
FIG. 2 is a schematic sectional view of a sewage disposal apparatus mounted in a washing machine according to the present invention.

Referring to FIGS. 1 and 2, a washing machine having a sewage disposal apparatus according to the present invention, includes an external casing 10 which forms the outline of the washing machine, an external tank 12 installed in the external casing 10, and a cylindrical cleaning container 14 which is rotatably installed in the external tank 12. A driving motor 16 and a shaft assembly 18 are installed in the lower portion of the external tank 12. The power of the driving motor 16 is transmitted to the shaft assembly 18 via a belt 20. The shaft assembly 18 drives a pulsator 22 to rotate via a shaft during a washing process to rotate the wash (laundry) contained in the cleaning container 14 and drives the cleaning container 14 to rotate during a dehydration process.

A drain valve 74 and a drain pipe 76 connected to the drain valve 74 are installed in the lower portion of the external tank 12. The drain pipe 76 is connected to an inlet 85 of a sewage disposal apparatus 80. The sewage disposal apparatus 80 has a sewage water processing tank 81 through which the sewage water is purified and an outlet 86 through which the processed sewage water is externally discharged. A filtration filter 83 for filtering wash leftovers is installed in the inlet 85 of the cleaning water processing tank 1. An end of the inlet 85 of the sewage disposal apparatus 80 is formed of a hook shape to be detachably connected with the drain pipe 76.

The anodes 84 and cathodes 82 each formed of a plate body are alternately installed and distant by about 1 cm from each other, to form a zigzag path of the sewage water flow. Here, the anodes 84 are connected to a positive electrode of a power supply 88, and the cathodes 82 are connected to a negative electrode thereof, to receive power from the power supply 88.

The washing machine having the above construction performs a washing process of the wash contained in the cleaning container 14. Then, the sewage water after washing flows out into the cleaning water processing tank 81 via the inlet 85 of the sewage disposal apparatus 80 along the drain pipe 76 when the drain valve 74 is open. At this time, the textile leftovers or other organic matter contained in the sewage water are filtered via the filtration filter 83 provided upstream of the cleaning water processing tank 81, and the filtered sewage water flows between the anodes 84 and the cathodes 82 in zigzag form, and is electrolytically decomposed by the anodes 84 and the cathodes 82 both of which are connected to the power supply 88. Accordingly, surfactants contained in the sewage water are decomposed and pollution materials such as suspended solids and organic matter are condensed and deposited. As a result, the sewage water from which the pollution materials are removed is discharged out of the washing machine via the outlet 86. If a mass of the solids such as the textile leftovers are attached to the filtration filter 83 in the result of repetitive washing, the inlet 85 of the sewage disposal apparatus 80 formed of a hook shape is separated from the drain pipe 76 to replace the filtration filter 83.

To electrolytically decompose the sewage water after washing, the electrical conductivity of the sewage water should be 600 $\mu$S/cm or more, and the pH value is properly 7–10. Most of the sewage water after washing satisfies the above two conditions, therefore, a direct electrolysis reaction can be performed without additional treatments. The electrodes 82 and 84 installed in the cleaning water processing tank 81 are made of iron or aluminum. When an alkalinity or acidity of the sewage water is high, a DSA (dimensionally stable anode) can be used which is formed of double film in which Ru, Ir, Sn or an alloy of two or more of the Ru, Ir and Sn is coated on the metal layer of Ti having a purity of 99.9% or more.

When an iron electrode is used, all oxidation-reduction reaction formula in each electrode 82 or 84 is the same as the following chemical formula 1 or 2. When an aluminum electrode is used, the oxidation-reduction reaction formula is the same as the following chemical formula 3 or 4.

[Chemical Formula 1]

$$Fe \rightarrow Fe^{3+} + 3e^-$$

[Chemical Formula 2]

$$Fe^{3+} + 3OH^- \rightarrow Fe(OH)_3 \downarrow$$

[Chemical Formula 3]

$$Al \rightarrow Al^{3+} + 3e^-$$

[Chemical Formula 4]

$$Al^3 + 3OH^- \rightarrow Al(OH)_3 \downarrow$$

That is, aluminum or iron is solved out as cations in the result of oxidation reaction at the anodes 84 in the cleaning water processing tank 81, and the components of the synthetic detergent are decomposed. Meanwhile, the metal ions produced from the anodes 84 are combined with hydroxide ions ($OH^-$) in the result of reduction reaction at the cathodes 82, to produce $Fe(OH)_2$, $Fe(OH)_3$, or $Al_2(OH)_3$ which plays a role of cohesive agent. Accordingly, pollution matter such as inorganic or organic matter is agglomerated and deposited, and a heavy metal contained in the sewage water is reduced and extracted.

Also, the hydroxide produced in the electrolytic process has a very strong adsorption and adsorbs even components such as solved solid or liquid particles.

Figure 3:
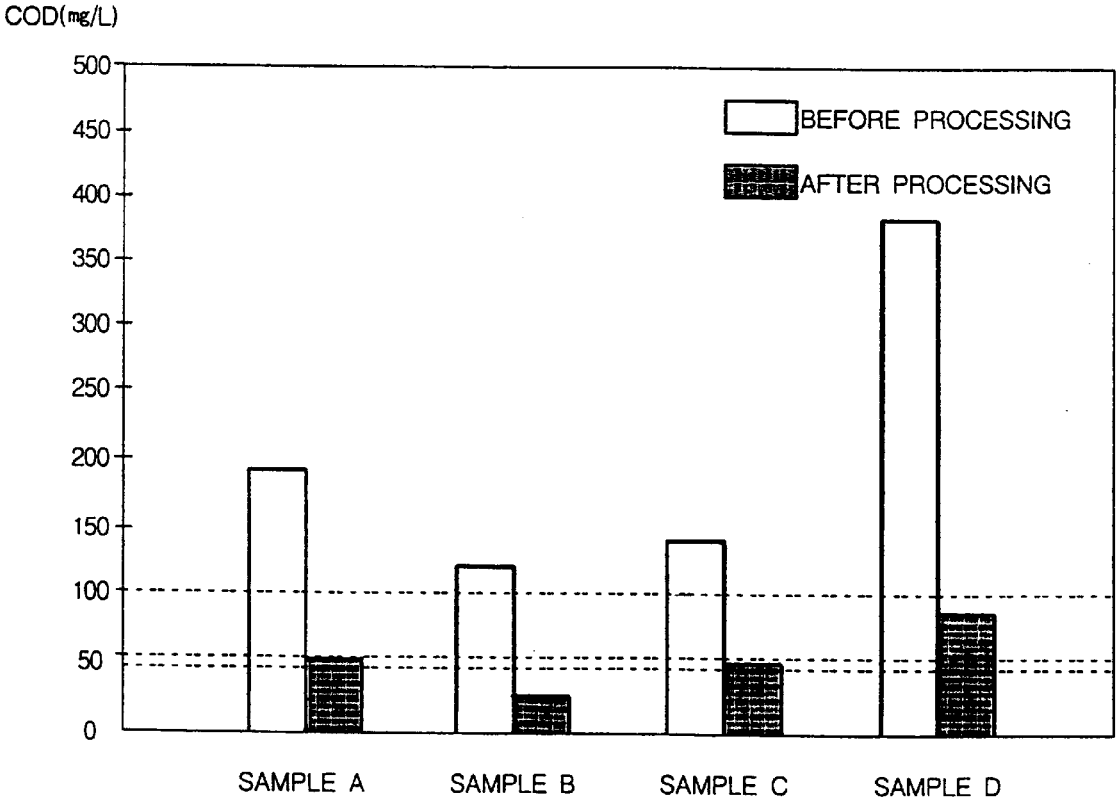
FIG. 3 is a graphical view indicative of the change of COD in the sewage water before and after passing through the sewage disposal apparatus.

FIG. 3 is a graphical view indicative of the change of COD in the sewage water before and after passing through the sewage disposal apparatus 80. Here, four test materials A, B, C and D are the samples of the sewage water after washing with four different synthetic detergents. As shown in the graph, the CODs of all the samples of the sewage water obtained before passing through the sewage disposal apparatus 80 exceed a legal permissible reference value, that is, 100 ppm. After passing through the sewage disposal apparatus 80, the CODs fall below the legal permissible reference value 100 ppm irrespective of the kinds of the samples.

The reason lies in the fact that the electrolytic decomposition of the water produces a hydrogen gas at the cathode and an oxygen gas at the anode, the produced oxygen and hydrogen gases have high oxidation and reduction functions to thereby bring about a secondary reaction with the pollution matter contained in the sewage water, and to lower the COD and the BOD through an oxidation reaction, particularly. At the same time, the electrolysis removes the pigments to thereby make the chromaticity of the sewage water clear. Further, the produced oxygen has an effect of sterilizing and removing a bad smell.

Figure 4:
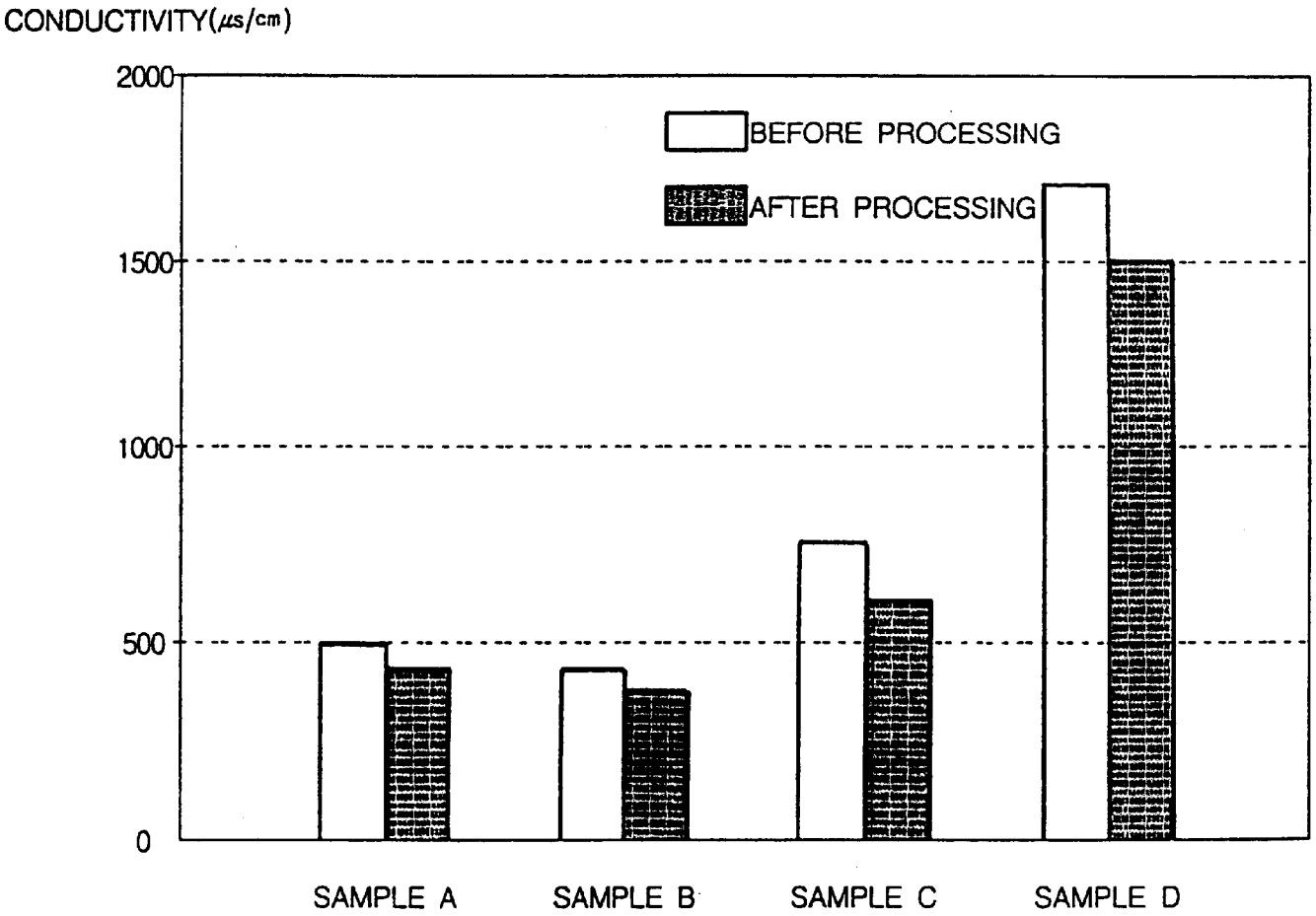
FIG. 4 is a graphical view indicative of the change of conductivity in the sewage water before and after passing through the sewage disposal apparatus.

FIG. 4 is a graphical view indicative of the change of conductivity in the sewage water before and after passing through the sewage disposal apparatus 80. As can be seen from the graph, the conductivity of the sewage water tends to be reduced after passing through the sewage disposal apparatus 80, from which it can be known that heavy metal ions contained in the sewage water are reduced into metals through a reduction reaction and then are precipitated to thereby remove conductive metal ions.

Figure 5:
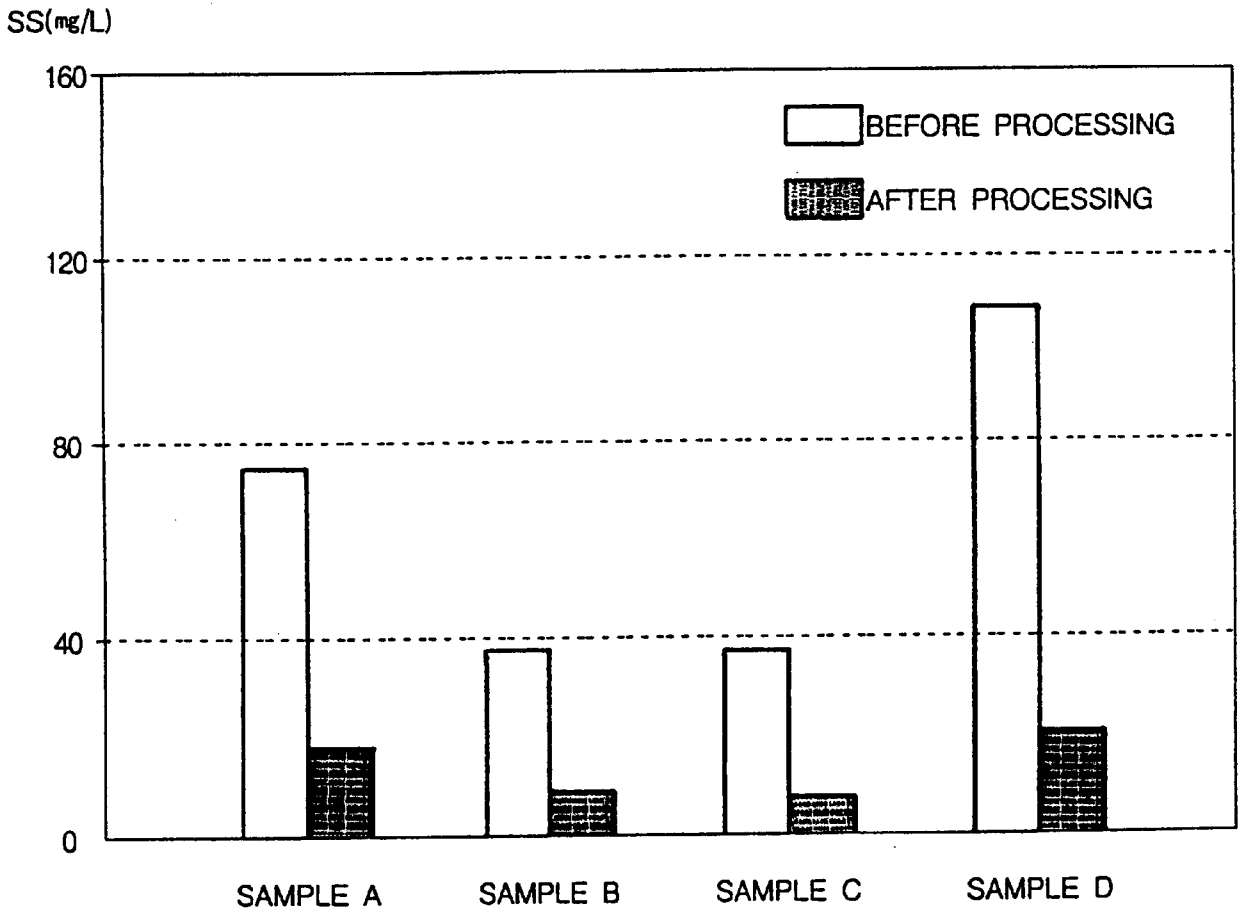
FIG. 5 is a graphical view indicative of the change of concentration of suspended solids in the sewage water before and after passing through the sewage disposal apparatus.
Figure 6:
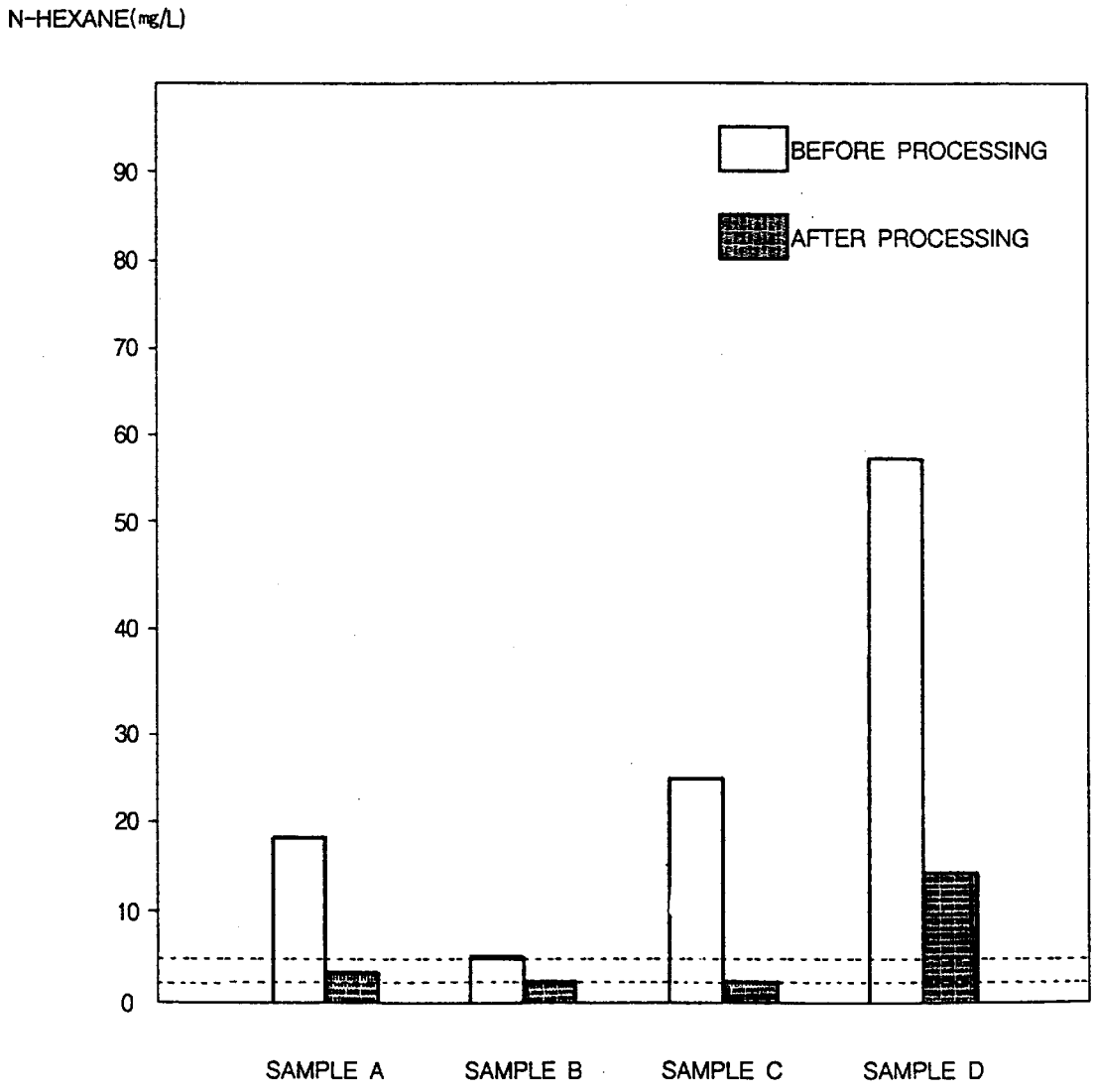
FIG. 6 is a graphical view indicative of the change of N-hexane concentration in the sewage water before and after passing through the sewage disposal apparatus.

FIG. 5 is a graphical view indicative of the change of concentration of suspended solids (SS) in the sewage water before and after passing through the sewage disposal apparatus 80. FIG. 6 is a graphical view indicative of the change of N-hexane concentration in the sewage water before or after passing through the sewage disposal apparatus 80. As can be seen from the graphs, the suspended solids fall below a discharge permissible reference value of a clean area, that is, 40 ppm, and the N-hexane concentrations fall below half the concentration before passing through the sewage disposal apparatus 80.

Figure 7:
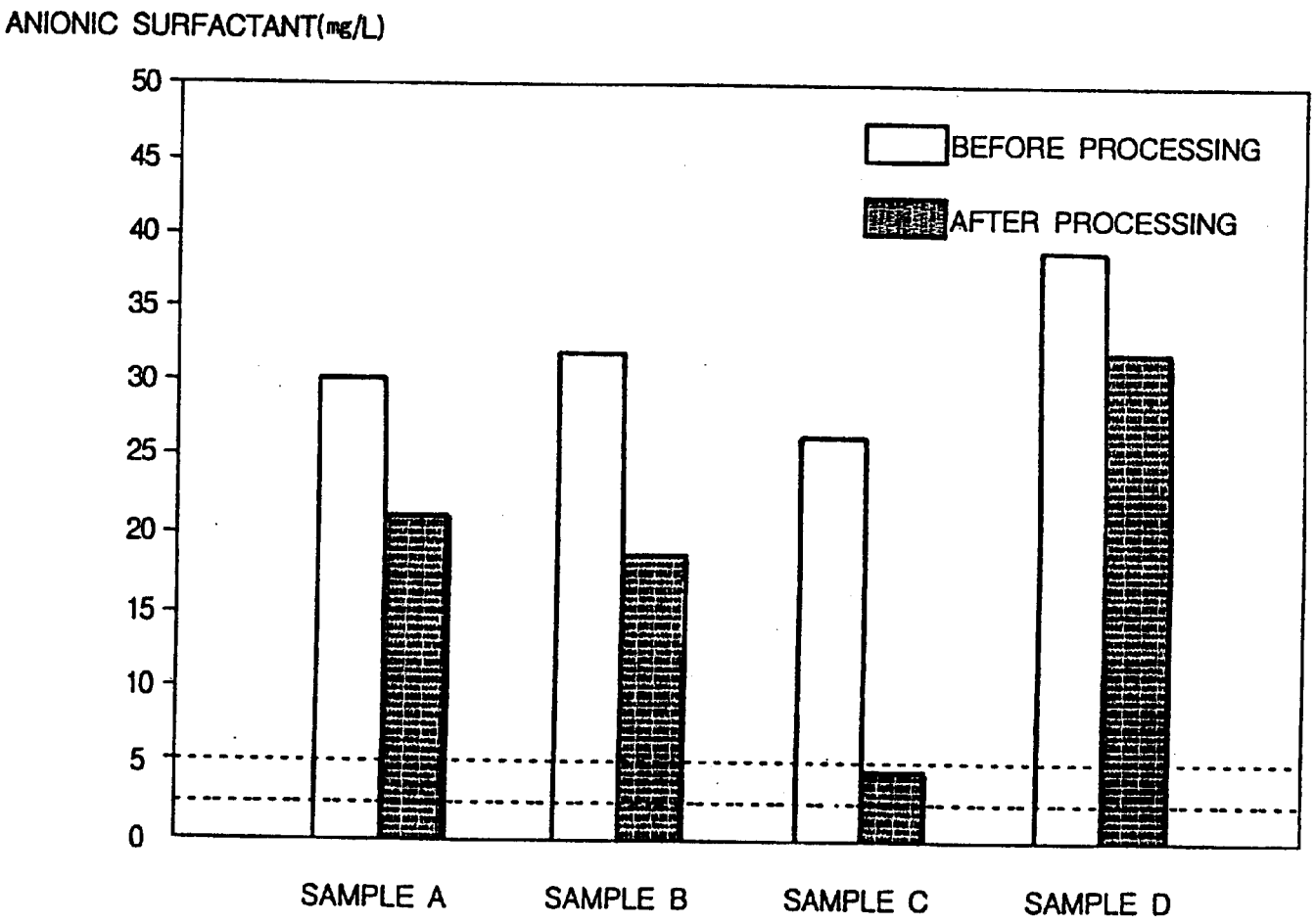
FIG. 7 is a graphical view indicative of the change of concentration of an anionic surfactant in the sewage water before and after passing through the sewage disposal apparatus.

FIG. 7 is a graphical view indicative of the change of concentration of an anionic surfactant in the sewage water before and after passing through the sewage disposal apparatus 80. It is very difficult to remove the surfactants among the components of the synthetic detergents. From 25–80% of the surfactants can be removed according to the test samples using the sewage disposal apparatus 80.

Meanwhile, since the sewage water after washing contains a variety of organic matter, it is very difficult to analyze the pollution matter and the oxidized products during the electrolytic oxidation process. Further, such an analysis does not provide a crucial result, that is, direct information between a reaction efficiency and organic matter. Therefore, when the sewage water after washing is electrolytically processed, a processing efficiency can be measured by calculating an instantaneous current efficiency as a general electrochemical parameter or calculating a power consumed per a unit weight of an organic matter.

Thus, the present invention provides a washing machine having a sewage disposal apparatus capable of removing polluted matter such as surfactants, suspended solids and organic matter contained in the sewage water using an electrolysis, to self-purify the sewage water after washing.

What is claimed is:

1. A clothes washing machine having a cleaning container and an electrolytic sewage disposal apparatus, the electrolytic sewage disposal apparatus comprising:

a sewage water processing tank having an inlet for receiving sewage water discharged from said cleaning container, a processing chamber for processing the sewage water, and an outlet for discharging the processed sewage water;

an electrolysis device mounted in the processing chamber and including at least one pair of an anode and a cathode arranged in spaced, opposing relationship;

a power supply for supplying electrical power to said anode and cathode; and an external tank in which the cleaning container is disposed, the external tank including a drain to which the inlet of the processing tank is connected.

2. The clothes washing machine according to claim 1 further including a filter disposed between said cleaning container and said processing chamber.

3. The clothes washing machine according to claim 1 wherein there is a plurality of said anodes and a plurality of said cathodes, said anodes and cathodes disposed in alternating relationship.

4. The clothes washing machine according to claim 3 wherein the alternating anodes cathodes form a zig-zag travel path for sewage water.

5. The clothes washing machine according to claim 4 wherein the anodes and cathodes are made of aluminum.

6. The clothes washing machine according to claim 4 wherein the anodes and cathodes are formed of iron.

7. The clothes washing machine according to claim 4 wherein each of the anodes and cathodes comprises a dimensionally stable member.

8. The clothes washing machine according to claim 1 wherein the drain is detachably connected to the inlet of the processing tank.

* * * * *